US007197974B2

(12) United States Patent
Glasson

(10) Patent No.: US 7,197,974 B2
(45) Date of Patent: Apr. 3, 2007

(54) POSITION SENSOR

(75) Inventor: Richard O. Glasson, Whippany, NJ (US)

(73) Assignee: Control Products Inc., East Hanover, NJ (US)

( * ) Notice: Subject to any disclaimer, the term of this patent is extended or adjusted under 35 U.S.C. 154(b) by 37 days.

(21) Appl. No.: 10/757,858

(22) Filed: Jan. 15, 2004

(65) Prior Publication Data

US 2005/0160864 A1 Jul. 28, 2005

(51) Int. Cl.
*F15B 15/28* (2006.01)
*G05D 5/02* (2006.01)

(52) U.S. Cl. ..... 92/5 R; 33/763

(58) Field of Classification Search ..... 91/1; 92/5 R; 33/761, 762, 763
See application file for complete search history.

(56) References Cited

U.S. PATENT DOCUMENTS

| | | | | |
|---|---|---|---|---|
| 2,498,799 | A | 2/1950 | Erickson | |
| 3,403,365 | A | 9/1968 | Richards | |
| 3,777,273 | A | 12/1973 | Baba et al. | |
| 3,894,250 | A * | 7/1975 | Hager et al. | 327/511 |
| 3,988,710 | A | 10/1976 | Sidor et al. | |
| 4,005,396 | A | 1/1977 | Fujiwara et al. | |
| 4,057,904 | A | 11/1977 | Vrable et al. | |
| 4,121,504 | A | 10/1978 | Nowak | |
| 4,214,180 | A | 7/1980 | Kuwako et al. | |
| 4,231,700 | A | 11/1980 | Studebaker | |
| 4,286,386 | A | 9/1981 | Long | |
| 4,288,196 | A | 9/1981 | Sutton, II | |
| 4,319,864 | A | 3/1982 | Kaufeldt | |
| 4,342,884 | A | 8/1982 | Ban et al. | |
| 4,356,557 | A | 10/1982 | Bell et al. | |
| 4,367,998 | A | 1/1983 | Causer | |
| 4,386,552 | A | 6/1983 | Foxwell | |
| 4,413,245 | A | 11/1983 | Bartholomaus et al. | |
| 4,425,557 | A | 1/1984 | Nakamura | |
| 4,480,151 | A | 10/1984 | Dozier | |
| 4,488,014 | A | 12/1984 | Daniel et al. | |

(Continued)

FOREIGN PATENT DOCUMENTS

| | | |
|---|---|---|
| DE | 2635614 | 2/1978 |

(Continued)

OTHER PUBLICATIONS

Patent Abstract of JP 11211410 Jitosho, Aug. 6, 1999.

(Continued)

*Primary Examiner*—Thomas E. Lazo

(57) ABSTRACT

A position sensor includes a stationary frame supporting a rotatable spool onto which a cable is wound in a plurality of individual windings. A distal end of the cable extends through a lead guide for attachment to an object whose position is desired to be sensed. As the object moves, the cable is would or unwound about the spool and the spool rotates in direct correlation to the movement of the object. The spool is retained in the frame through a threaded engagement between a threaded extension extending from the spool and a threaded opening in the frame. Thus, as the spool rotates, the spool travels along a linear path and a sensor determines the location of the threaded extension to determine the location of the object. A recoil spring is used which may be located within the spool itself.

49 Claims, 8 Drawing Sheets

U.S. PATENT DOCUMENTS

| | | | | |
|---|---|---|---|---|
| 4,497,375 | A | 2/1985 | Mucheyer et al. | |
| 4,653,190 | A | 3/1987 | Spain, Jr. | |
| 4,737,698 | A | 4/1988 | McMullin et al. | |
| 4,914,389 | A | 4/1990 | Juds | |
| 4,945,221 | A | 7/1990 | Nielsen et al. | |
| 4,989,329 | A | 2/1991 | Pullen | |
| 4,999,579 | A | 3/1991 | Winfried | |
| 5,024,250 | A | 6/1991 | Nakamura | |
| 5,046,243 | A | 9/1991 | Walker | |
| 5,156,242 | A | 10/1992 | Ditzig | |
| 5,200,747 | A | 4/1993 | Betz et al. | |
| 5,203,723 | A | 4/1993 | Ritter | |
| 5,341,724 | A | 8/1994 | Vatel | |
| 5,364,043 | A | 11/1994 | Linderoth | |
| 5,389,876 | A | 2/1995 | Hedengren et al. | |
| 5,404,661 | A | 4/1995 | Sahm et al. | |
| 5,444,369 | A | 8/1995 | Luetzow | |
| 5,467,938 | A | 11/1995 | Redman | |
| 5,659,248 | A | 8/1997 | Hedengren et al. | |
| 5,681,006 | A | 10/1997 | Herd et al. | |
| 5,693,935 | A | 12/1997 | Hassler, Jr. et al. | |
| 5,694,042 | A | 12/1997 | Eaton et al. | |
| 5,701,793 | A | 12/1997 | Gardner et al. | |
| 5,752,811 | A | 5/1998 | Petro | |
| 5,757,179 | A | 5/1998 | McCurley et al. | |
| 5,768,946 | A | 6/1998 | Fromer et al. | |
| 5,789,917 | A | 8/1998 | Oudet et al. | |
| 5,841,274 | A | 11/1998 | Masreliez et al. | |
| 5,894,678 | A | 4/1999 | Masreliez et al. | |
| 5,901,458 | A | 5/1999 | Andermo | |
| 5,936,399 | A | 8/1999 | Andermo et al. | |
| 5,955,881 | A | 9/1999 | White et al. | |
| 5,973,494 | A | 10/1999 | Masreliez et al. | |
| 6,160,395 | A | 12/2000 | Goetz et al. | |
| 6,234,061 | B1 * | 5/2001 | Glasson | 92/5 R |
| 6,259,249 | B1 | 7/2001 | Miyata et al. | |
| 6,279,248 | B1 | 8/2001 | Walters | |
| 6,335,618 | B1 | 1/2002 | Nahum | |
| 6,353,314 | B1 | 3/2002 | Moerbe | |
| 6,360,449 | B1 | 3/2002 | Steentjes | |
| 6,381,863 | B1 | 5/2002 | Steinich | |
| 6,443,385 | B1 | 9/2002 | Grandauer et al. | |
| 6,487,787 | B1 | 12/2002 | Nahum et al. | |
| 6,499,225 | B1 | 12/2002 | Steinich | |
| 6,501,264 | B2 | 12/2002 | Shiraishi et al. | |
| 6,522,129 | B2 | 2/2003 | Miyata | |
| 6,543,152 | B1 | 4/2003 | Steinich | |
| 6,545,461 | B1 | 4/2003 | Miyata | |
| 6,611,138 | B2 | 8/2003 | Vasiloiu | |
| 6,636,035 | B2 | 10/2003 | Kiriyama et al. | |
| 6,646,434 | B2 | 11/2003 | Miyata et al. | |
| 6,669,135 | B1 | 12/2003 | Hartley | |
| 6,768,321 | B2 * | 7/2004 | Wain et al. | 324/699 |
| 6,825,709 | B2 * | 11/2004 | Motz | 327/513 |
| 2003/0131724 | A1 | 7/2003 | Neumann | |

FOREIGN PATENT DOCUMENTS

| | | |
|---|---|---|
| DE | 3835782 | 4/1990 |
| DE | 19908036 | 8/2000 |
| EP | 0505297 | 9/1992 |
| EP | 0325787 | 8/1993 |
| EP | 0896855 A | 2/1999 |
| FR | 2794236 | 12/2000 |
| JP | 11211410 | 8/1999 |
| WO | WO-9955613 | 11/1999 |

OTHER PUBLICATIONS

Applied Technologies Group, *Part Design for Ultrasonic Welding*, Branson, Nov. 1999.

Applied Technologies Group, *Ultrasonic Staking*, Branson, Nov. 1999.

Murakami, Taku, *Precision Angle Sensor Unit for Construction Machinery*, International Off-Highway & Powerplant Congress & Exposition, Sep. 8-10, 1997.

Examination Report for EP1443218 (Application No. 04009658.8), dated Sep. 6, 2005.

Examination Report for EP1123464B (Application No. 99970715.1), dated Nov. 22, 2002.

* cited by examiner

POSITION SENSOR

FIELD OF THE INVENTION

The invention generally relates to position sensors, and more particularly to a position sensor operable within a cylinder.

BACKGROUND

There are different types of sensors that sense the position of some physical object and provide information as to the location or movement of that object. One such sensor is shown and described in pending U.S. patent application Ser. No. 09/793,218 entitled "PRECISION SENSOR FOR A HYDRAULIC CYLINDER" and which, in turn, is a continuation-in-part of U.S. Pat. No. 6,234,061, issued on May 22, 2001, entitled "PRECISION SENSOR FOR A HYDRAULIC CYLINDER" and which was based upon U.S. Provisional application 60/104,866 filed on Oct. 20, 1998 and the disclosure of all of the foregoing applications and issued U.S. Patent are hereby incorporated into this specification by reference.

Some applications for these sensors call for a sensor that is as small as possible and, in particular, where the sensor is located within a hydraulic cylinder and where the piston movement is relatively long. The need for relatively long piston movement requires a relatively lengthy connection between the moving piston and the related fixed point of the cylinder. Where the connection is a cable winding about a rotating spool, increased cable length, and perforce windings, may increase the probability of overlapping of the cable coils on the rotating spool.

SUMMARY OF THE INVENTION

A sensor according to the present invention provides a spool position sensor having an extended range of detection of an object, such as a piston within a cylinder, within a relatively small physical package. In one aspect of the invention, a spool is provided that moves so as to substantially align the feed point of the cable to the rotating spool such that the winding is aligned with the rest of the cable. As the spool rotates, it continues to move so that each successive winding does not overlap a previous winding, while such successive windings are made in substantial alignment with the cable length.

In another aspect, a sensor according to the position sensor of the present invention includes a rotatable spool around which the cable is coiled in a plurality of individual windings. A distal end of the cable is affixed to the object desired to be sensed. The winding and unwinding of the measuring cable causes the spool to rotate in accordance with the amount of cable extended or retracted from spool. The spool translates or travels along a linear path along the rotational axis of the spool as the cable winds and unwinds.

The position sensor can include a non-contacting sensor element, such as a Hall-effect sensor that then senses the linear travel. This sensor element can be fixed to the sensor frame and a magnetic target that is fixed to the linearly moving spool or an extension thereof so that an absolute position signal can be obtained in direct relation to the position of the object being sensed. The sensor can be encapsulated in epoxy to provide protection against pressure and immersion in fluid. Furthermore, the hydraulic cylinder acts as a magnetic shield against spurious fields that could impart measurand error.

DETAILED DESCRIPTION

Figure 1:
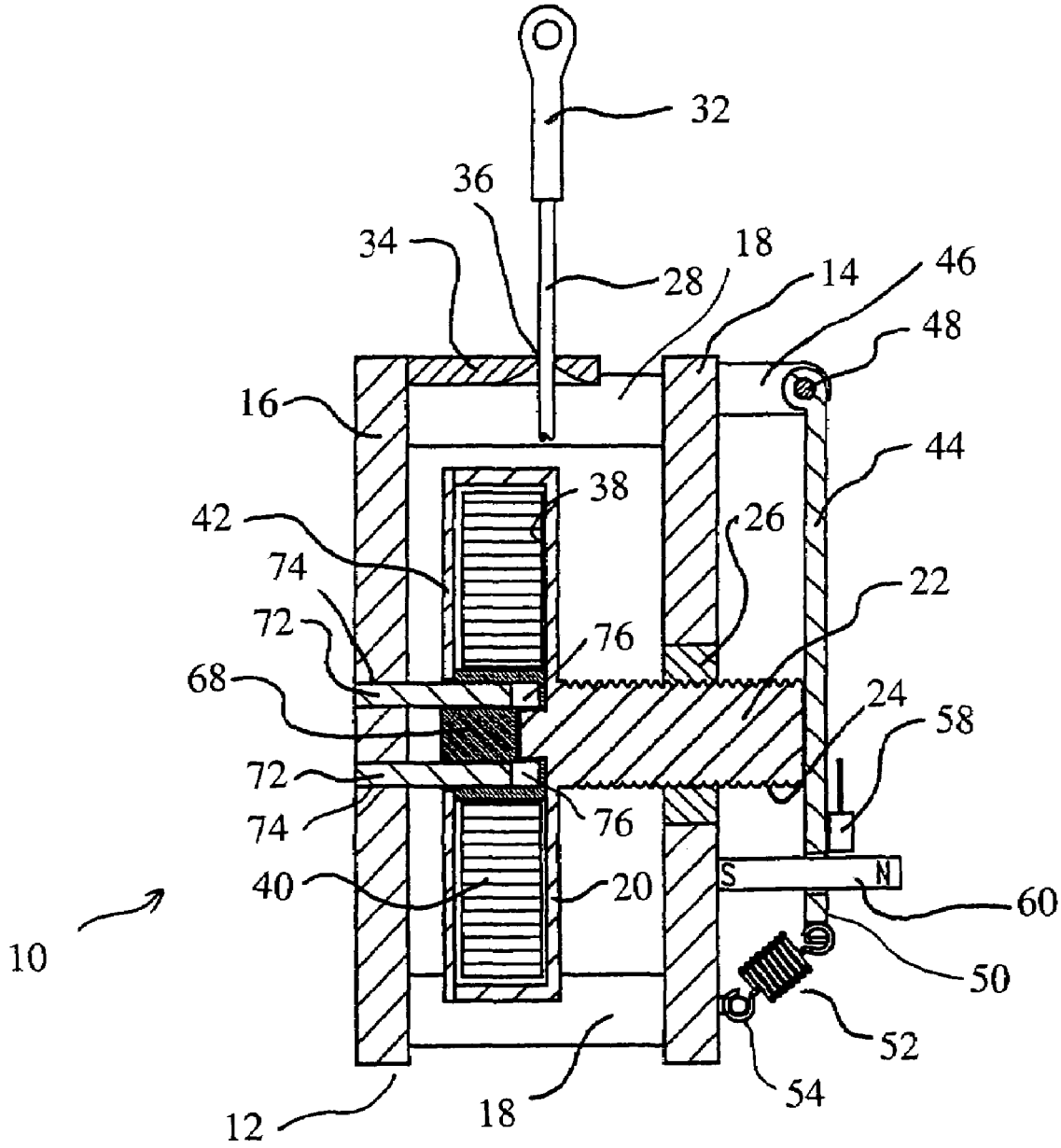
FIG. 1 is a side cross-sectional view of a position sensor constructed in accordance with the present invention.

In FIG. 1, there is shown a perspective view of a position sensor 10 constructed in accordance with the present invention. A use of the position sensor 10 is shown and described in the aforementioned U.S. Pat. No. 6,234,061. As such, in FIG. 1 there can be seen a stationary frame 12 that contains the components that make up the position sensor 10 and the stationary frame 12 includes a front plate 14 and a rear plate 16 that are held together a predetermined distance apart by means of spacers 18. The frame is stationary in relation to the object to be sensed. Both the front and rear plates 14, 16 can be constructed of steel or other relatively rigid material, including plastic materials. While a particular frame is described herein, the use of a frame is intended to provide support for the various components that make up the present invention, and the frame itself can take a variety of different shapes and configurations and may even be a portion of the cylinder when the present invention is used to detect the position of a piston moving within a cylinder.

Rotatably mounted within the stationary frame 12 is a spool 20. Spool 20 has a threaded extension 22 extending outwardly therefrom along the rotational axis of the spool 20. As can be seen, the threaded extension 22 has male threads 24 and there is a threaded bushing 26 having corresponding female threads that is affixed to the front plate 14 so that there is a threaded engagement between the threaded extension 22 and the threaded bushing 26. As will be later explained, the particular pitch of the mating threads of the threaded extension 22 and the threaded bushing 26 are predetermined to carry out the preferred functioning of the position sensor 10.

Figure 2:
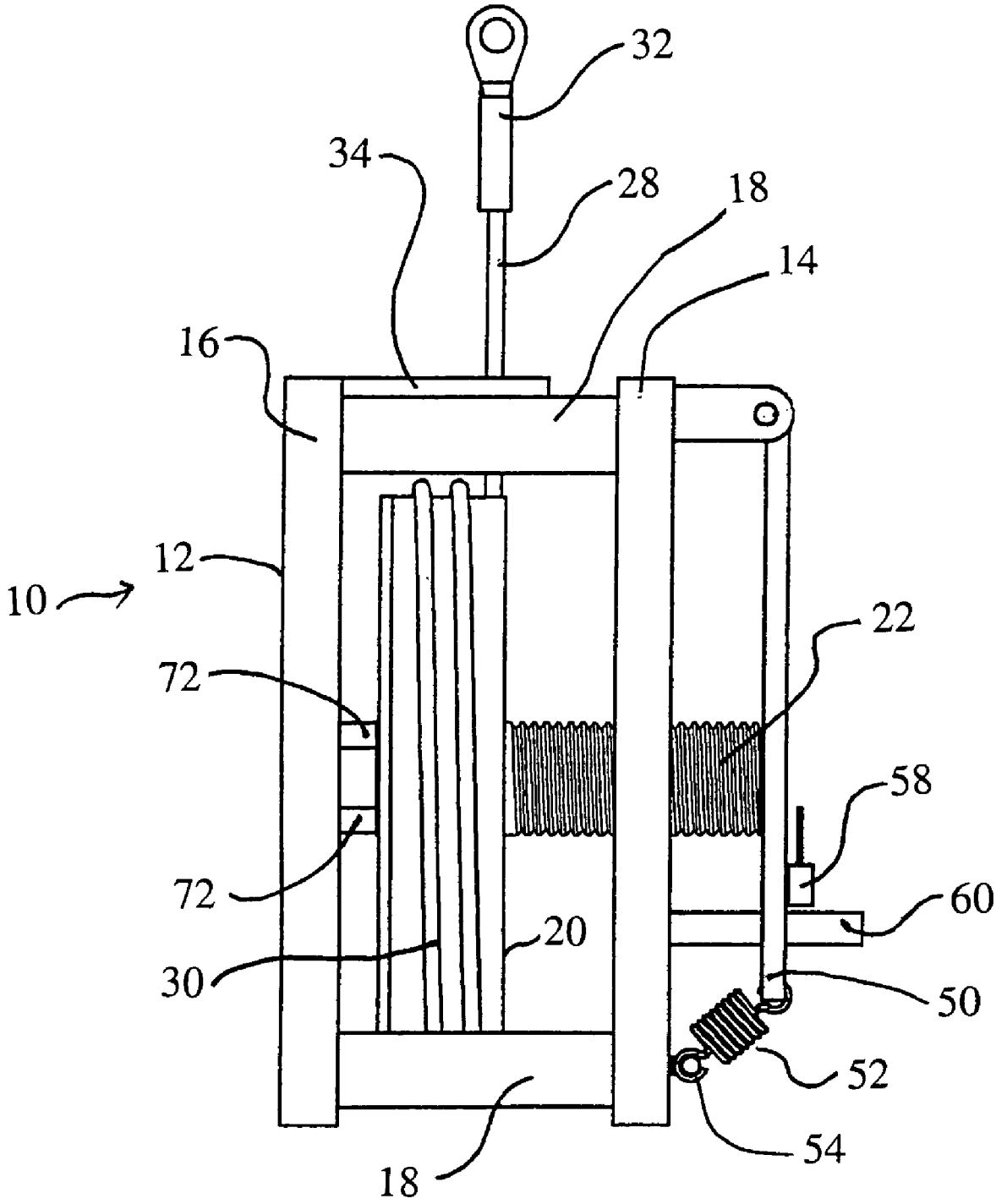
FIG. 2 is a side view of the position sensor of FIG. 1.

A cable 28 is wound about the external peripheral surface of the spool 20 to form cable loops or windings 30, shown specifically in FIG. 2, that encircle the spool 20. There can be a cable attachment 32 located at the distal end of the cable 28 adapted to be affixed to the particular object whose position is desired to be sensed by use of the position sensor 10. As previously explained, in the embodiment of U.S. Pat. No. 6,234,061, the object being sensed can be a piston to determine its position within a hydraulic cylinder. In any event, from the distal end of the cable 28 having the cable attachment 32, the cable 28 passes into the interior of the stationary frame 12 through a lead guide 34 having a feed point opening 36 that is the feed point for the cable 28 as it winds and unwinds about the spool 20.

At this point, it can be recognized that the spool 20 rotates within the interior of the stationary frame 12 as the cable 28 is wound and unwound onto and from the spool 20. As the spool 20 rotates, the threaded engagement between the threaded extension 22 and the threaded bushing 26 causes the spool 20 to travel a linear path along its axis of rotation, that is, along the main axis of the threaded extension 22. Thus, the linear travel of the spool 20 is in a direct correlation to the linear movement of the cable 28 and, of course, the linear movement of the particular object whose position is being sensed.

The rather long linear distance traveled by the object is converted to a rotary movement of the spool 20 and then further converted to a relatively short-term travel of the threaded extension 22 such that by sensing and determining the travel and position of the threaded extension 22, it is possible to obtain an accurate determination of the location of the object that is being sensed. The conversion is basically linear to rotary to linear motion or LRL.

Returning to FIGS. 1 and 2, in the embodiment shown, there is a hollowed out area 38 within the spool 20 such that a recoil spring 40 is located within the hollowed out area 38. The recoil spring 40 is essentially a spiral spring that biases the spool 20 in the direction that it will rotate to wind the cable 28 onto the spool 20, that is, the spool 20 is biased so that it will tend to rotate in the winding direction. The function of the recoil spring 40 will be later described; it being sufficient at this point to note that one end of the recoil spring 40 is affixed to the spool 20 and the other end of the recoil spring 40 is held fixed with respect to the stationary frame 12.

The recoil spring 40 could also be located exterior to the spool 20, however, as can be seen there is an inherent space limitation within the stationary frame 12 and there is a desire for such position sensors to be as small, dimensionally, as possible for many applications. As such, while the recoil spring 40 can be located in an external position to the spool 40, it takes up valuable space within the stationary frame 12 and limits the linear travel of the spool 20 as a simple result of having less space within the stationary frame 12. Accordingly, by locating the recoil spring 40 within the hollowed out area 38 of the spool 20, there is an efficient use of the already limited space within the stationary frame 12. To enclose the recoil spring 40 within the hollowed out area 38, there is also provided a cover plate 42 that is affixed to the open end of the spool 20.

There is also provided in the embodiment of FIG. 1 and 2 a mechanism to prevent backlash at the threaded connection between the threaded extension 22 and the threaded bushing 26. That backlash mechanism comprises an arm 44 that is pivotally mounted to the stationary frame 12 by means of a standoff bracket 46 where there is a pivot point 48 about which the arm 44 is pivotally affixed to the standoff bracket 46. At the free end 50 of the arm 44, there is located a spring 52 having one end affixed to the free end 50 of the arm 44 and its other end affixed to the stationary frame 12 at a connector 54.

The spring basically biases the free end 50 of the arm 44 toward the stationary frame 12 at connector 54 so that there is a bias created that provides a force at the contact point 56 where the arm 44 contacts the end of the threaded extension 22 and acts against that threaded extension 22. Thus, there is a constant force exerted against the threaded extension 22 with respect to the stationary frame 12 and which prevents the occurrence of backlash at the threaded connection engagement between the threaded extension 22 and the threaded bushing 26.

As previously explained, since the linear travel of the threaded extension 22 is a direct result of the movement of the object to be sensed, by sensing the movement or travel of the threaded extension 22, and thus, its position, it is possible to accurately determine the position of the object being sensed. According, there can be a wide variety of means to determine the travel and location of the threaded extension 22, in the embodiment of FIGS. 1 and 2, one of the sensing schemes can be through the use of the arm 44 which, as explained, moves directly with the threaded extension 22.

Accordingly, by sensing the movement of the arm 44, the linear travel of the threaded extension can also be determined. As such, in FIGS. 1 and 2, there is a sensor, such as a Hall-effect sensor 58 that is affixed to the arm 44, generally proximate to the free end 50 and which operates in conjunction with a target magnet 60 which is affixed in a stationary position with respect to the stationary frame 12 and sufficiently in close proximity to the Hall-effect sensor 58 to allow the Hall-effect sensor 58 to provide an electrical signal indicative of the position of the arm 44 and, thus, the position of the threaded extension 22. Again, other sensors can be used and the actual locations of the Hall-effect sensor 58 and the target magnet 60 could be reversed, that is, with the magnet affixed to the arm 44 and the Hall-effect sensor 58 affixed in a stationary position with respect to the stationary frame 12.

Figure 3:
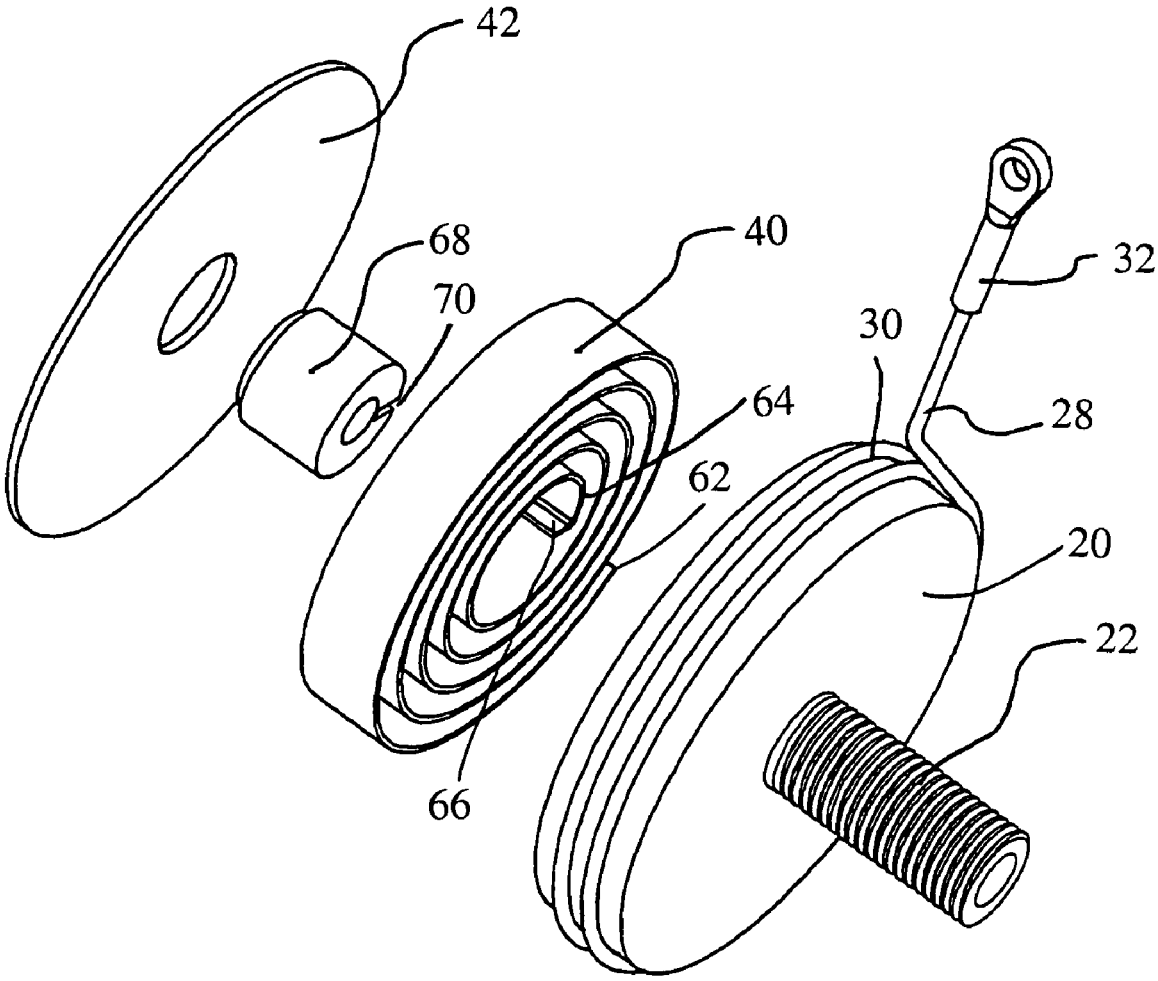
FIG. 3 is an exploded view of the recoil spool assembly and integral recoil spring of a sensor according to an exemplary embodiment of the present invention.

Turning now to FIG. 3, taken along with FIGS. 1 and 2, there is shown an exploded view of the recoil spring assembly according to the present invention. The recoil spring 40 has an outer end 62 that is adapted to be affixed to the internal surface of the spool 20 and an internal end 64 that forms a tab 66. In addition, there is a hub 68 having a slot 70 formed therein such that, in assembly, the tab 66 interfits within the slot 68 to retain the inner end 64 of the recoil spring 40 to the hub 68. The hub 68 is, in turn, affixed to the stationary frame 12 such that the inner end 64 of the recoil spring 40 is in a fixed position with respect to the stationary frame 12 while the outer end 62 can move or rotate along with the rotation of the spool 20 so as to exert a bias on the spool 20 tending to rotate the spool 20 in the direction of winding the cable 28 into cable loops 30 about the spool 20.

Thus, the hub 68 is affixed to the stationary frame 12 to prevent hub 68 from rotating while allowing the hub 68 to travel in a linear direction along with the spool 20. That affixation can be seen in FIGS. 1 and 2 where there are a pair of guide pins 72 that are affixed to the rear plate 16 at 74 and which extend inwardly to slidingly interfit into corresponding bores 76 formed in the hub 68. As such, the guide pins 72 prevent the hub 68 from rotational movement while allowing the hub 68 to travel along a linear path along with the spool 20 as the spool 20 travels linearly due to its threaded engagement with the stationary frame 12.

Advantageously, the diameter of the winding surface of the spool and the pitch of the threads on the threaded extension may be selected such that relatively long displacement of the distal end of the sensing cable will produce a corresponding, but much smaller, linear travel of the spool and threaded extension. Additionally, and in conjunction with the above description, the thread pitch of the threaded extension may be selected to provide both the shorter measurable linear movement as well as a single cable width's movement per full 360 degree turn of the spool. In such way, the present invention provides for LRL measurement and extended range in a simple, integrated configuration.

Figure 4:
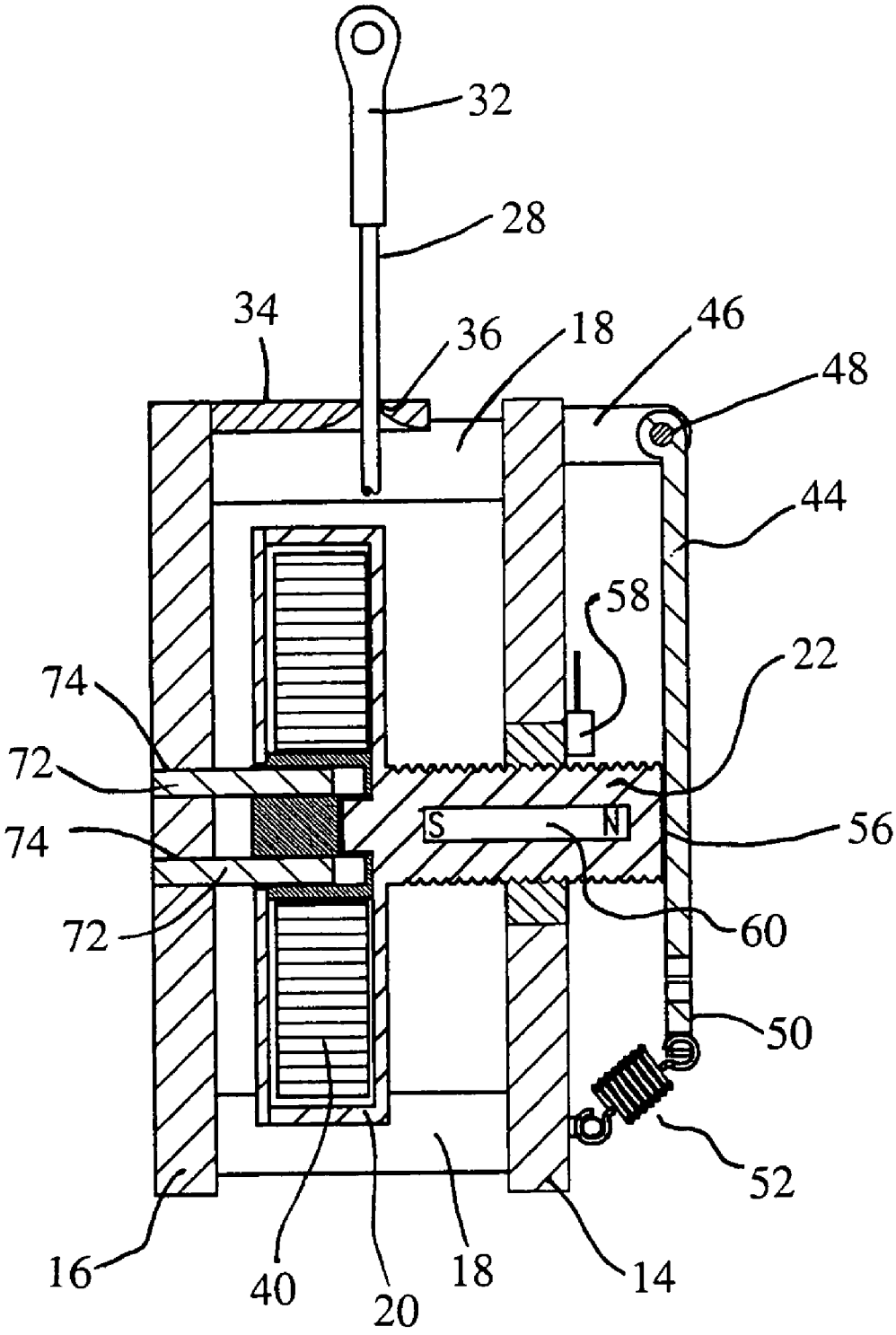
FIG. 4 is a side cross-sectional view of an embodiment of the present invention.

Turning now to FIG. 4, there is shown a side cross sectional view of an alternative embodiment of the present invention where the sensing scheme, or means of sensing the travel and location of the threaded extension 22 comprises the target magnet 60 mounted within the threaded extension 22 with the Hall-effect sensor 58 mounted in a fixed location on the front plate 14. Thus, in the embodiment of FIG. 4, the movement or travel of the threaded extension 22 is sensed directly rather than sensing the movement of the arm 44 in order to derive the movement of the threaded extension.

Figure 5:
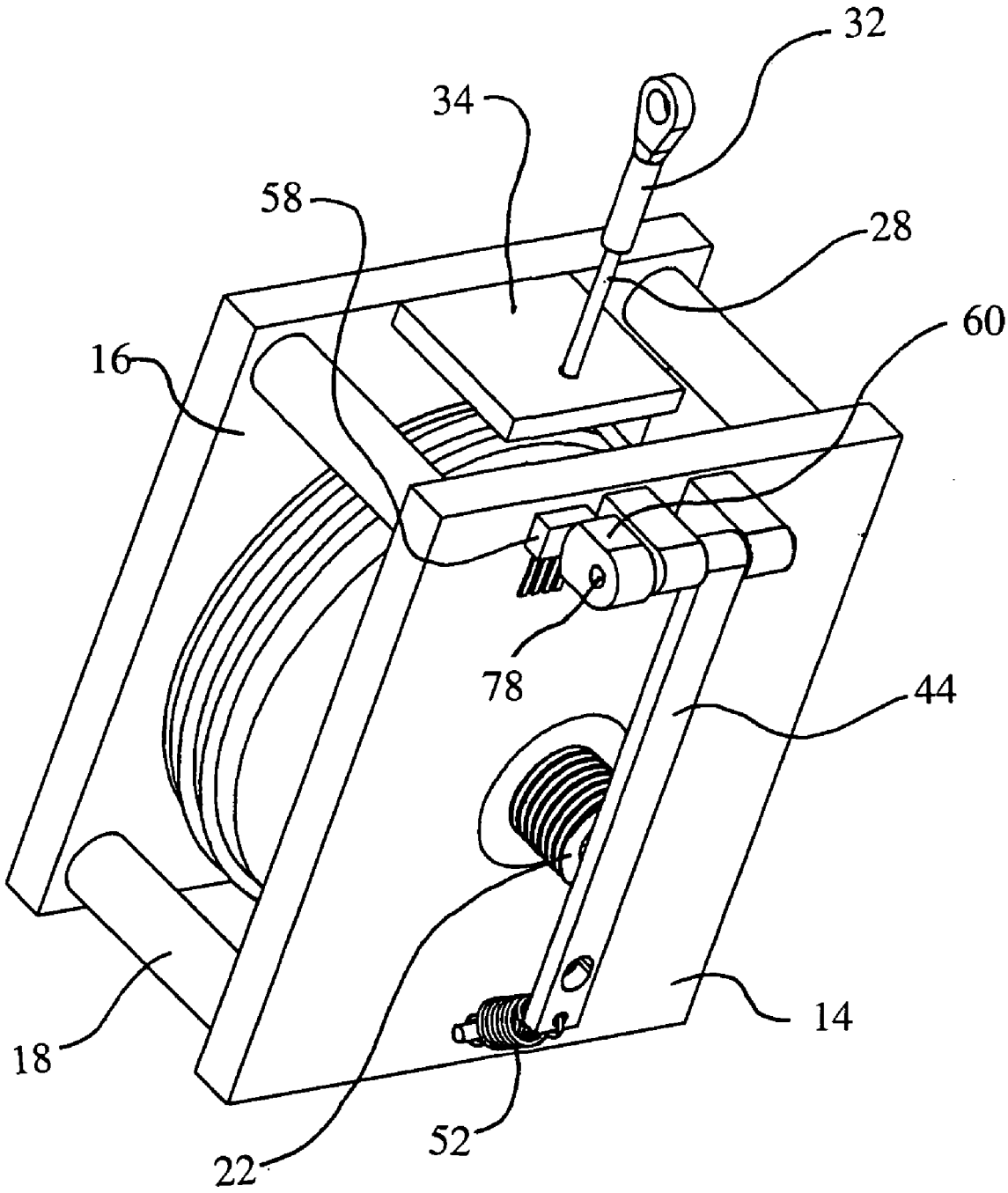
FIG. 5 is a perspective view of a position sensor according to the present invention.

Turning now to FIG. 5, there is shown a perspective view of a further embodiment where there is a sensor, such as a Hall-effect sensor 58 that is affixed to the front plate 14 and therefore held in a fixed position with respect to the stationary frame 12 and a target magnet 60 that is affixed to a common shaft 78 with the arm 44 and therefore pivots along with the arm 44 about pivot point 48. Accordingly, with this embodiment, the sensor actually measures the angular position and movement of the arm 44 to determine the movement and position of the threaded extension 22 to thereby glean the necessary data to accurately determine the movement and position of an object being sensed by the position sensor 10.

Figure 6A:
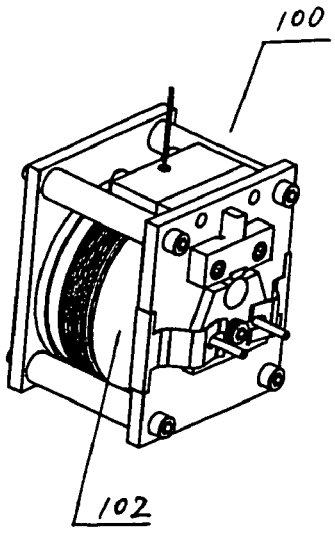
FIGS. 6A, 6B and 6C show an isometric assembled view, a partial exploded view, and a side view respectively of a sensor according to the principles of the invention.
Figure 6C:
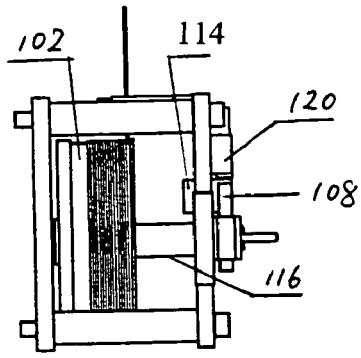
Figure 6B:
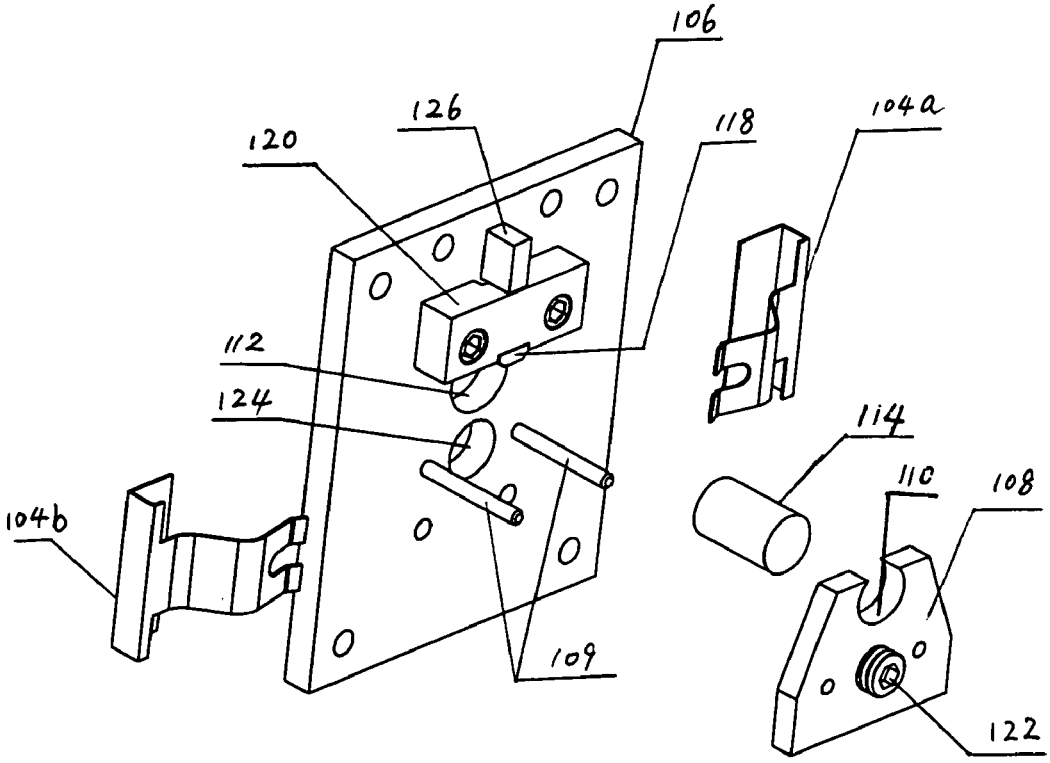

FIGS. 6A, 6B and 6C show an isometric view, partially exploded view and side view of another embodiment of a sensor 100 according to the principles of the invention. The principles of operation of this sensor 100 with respect to the rotating spool 102 are as previously described. In this sensor, however, magnet holding block 108 is slidably engaged with guide pins 109 and is adapted to hold a magnet via force fit in the area 110. The magnet 114 is moveable with the plate 106 in the hole 112 which permits the magnet 114 to move linearly with the magnet holding block 108. The magnet can be a Sintered Alnico 8, available as Part No. 29770 from the Magnetics Products Group of SPS Technologies, also known as Arnold Magnetics. The appropriate target magnet for a particular application can vary according to desired functionality and engineering considerations.

As can be seen in the side view of 6C, the magnet holding block 108 engages the rotating and translating spool 102 via a lead extension 116. The lead extension 116 travels linearly with the action of the rotating spool 102 according to the previously described principles, although the precise mechanisms need not be employed. In this arrangement, therefore, the magnet 114 can travel without rotating with the spool, and can be located proximate a Hall effect sensor 118 which is here shown partially hidden and affixed to the plate 106 via a mounting block 120. In this embodiment, the sensor 118 is an Allegro A3516L Ratiometric Hall-effect sensor. The engagement of the holding block 108 with the lead extension 116 includes an offset adjusting screw 122 and is made via hole 124 in plate 106. The adjust screw 122 changes the relationship of the magnet 114 to the sensor 118 by moving the holding block 108 relative to the extension 116. Anti-backlash springs 104*a,b* affix to the plate 106 and apply a translational force to the holding block 108, and, therefore to the lead 116 to prevent backlash due to thread dead space as previously described.

A compensating element 126 is also provided to compensate for measurand inaccuracies arising from temperature impacts on the Hall sensor 118 and the magnet. In this embodiment, the element 126 is a thermally responsive metal adapted to the Hall effect in use. As the metal expands or contracts with temperature, the sensor's 118 location respecting the magnet 114 changes to compensate for the sensor changes caused by temperature. Of course, other temperature compensation schemes can be employed, including electrical temperature compensation circuits adapted to the Hall effect and magnet combination in a particular implementation.

In one such electrical-based scheme, a reference Hall chip is used to sense inaccuracies and subtract them from the measurement signal. The reference Hall chip is mounted in fixed relation to the target magnet, and is operable to sense changes in magnetic field due to temperature, age or the like. The reference chip should be of the same type as the primary, and therefore subject to the same temperature or time induced errors. The inaccuracies or errors, measured at a common source and using a common method cancel out using appropriate subtraction type circuit. Examples of such circuits can be of the balanced amplifier type. This circuit can include other functionality, if desired, such as voltage regulation, scaling, feedback, gain and offset adjustments (either on-board or externally adjustable via connector) and protection against improper hookup.

Figure 7:
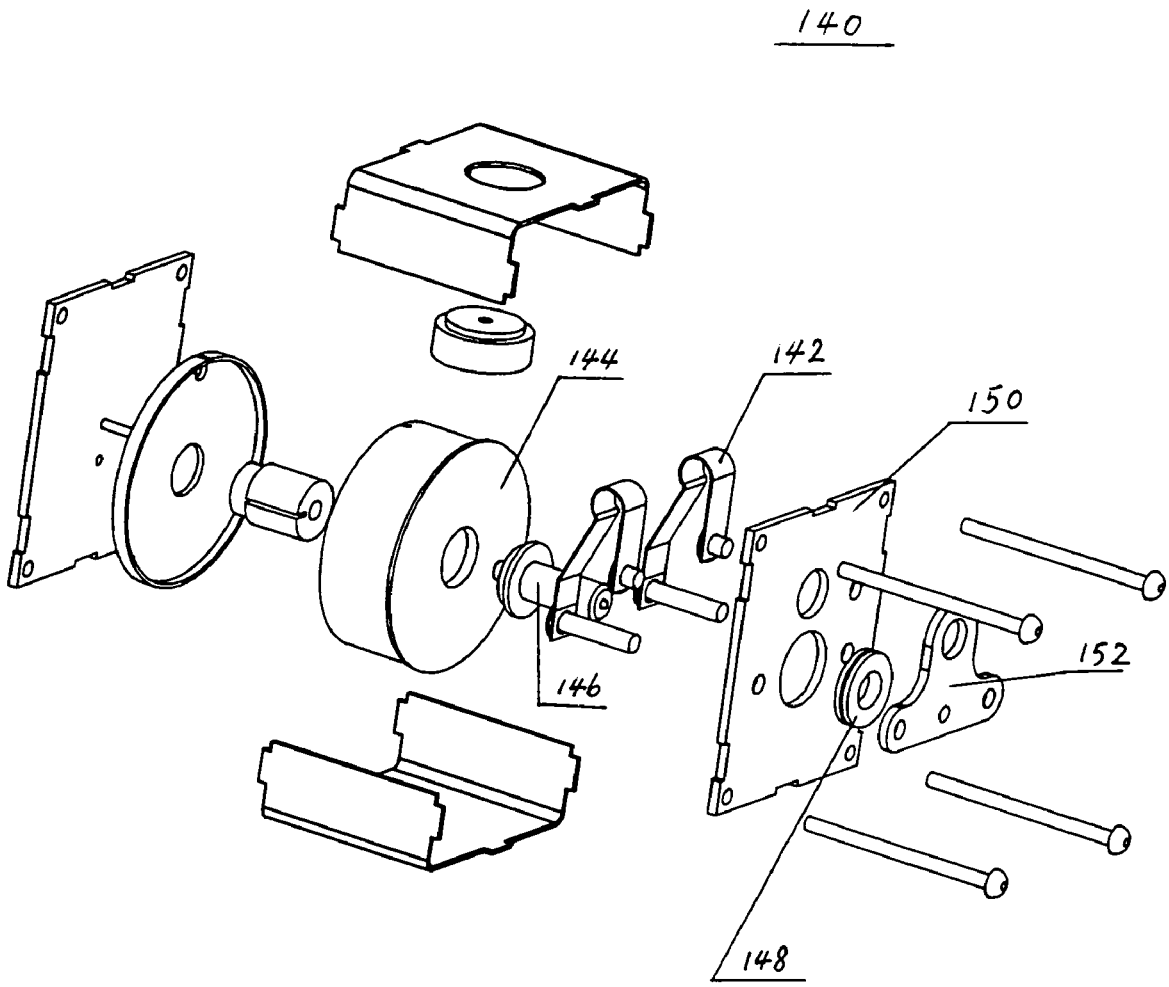
FIG. 7 shows an exploded view of another sensor according to the principles of the invention.

An exploded view of another embodiment of a sensor 140 according to the principles of the invention is shown in FIG. 7. The principles of operation of this embodiment are similar to that described in FIG. 6. As shown, however, the anti-backlash springs 142 apply force directly to the rotating spool 144, and the threaded extension 146 is fixed to the spool 144. An internally threaded insert 148 is fixed to the plate 150, such that when the spool 144 rotates, the threads of the extension and insert cooperate to move the spool laterally. Likewise, the carrier 152 also moves as it is in mechanical cooperation with the extension 146. Not shown in this embodiment is the particular transducer, although it should be appreciated that the configuration is well suited to a Hall effect sensor and magnet combination, and that in such combination an adjust screw and compensation element can be provided. Moreover, this embodiment is suited to a swage type construction, providing a low cost sensor.

Figure 8:
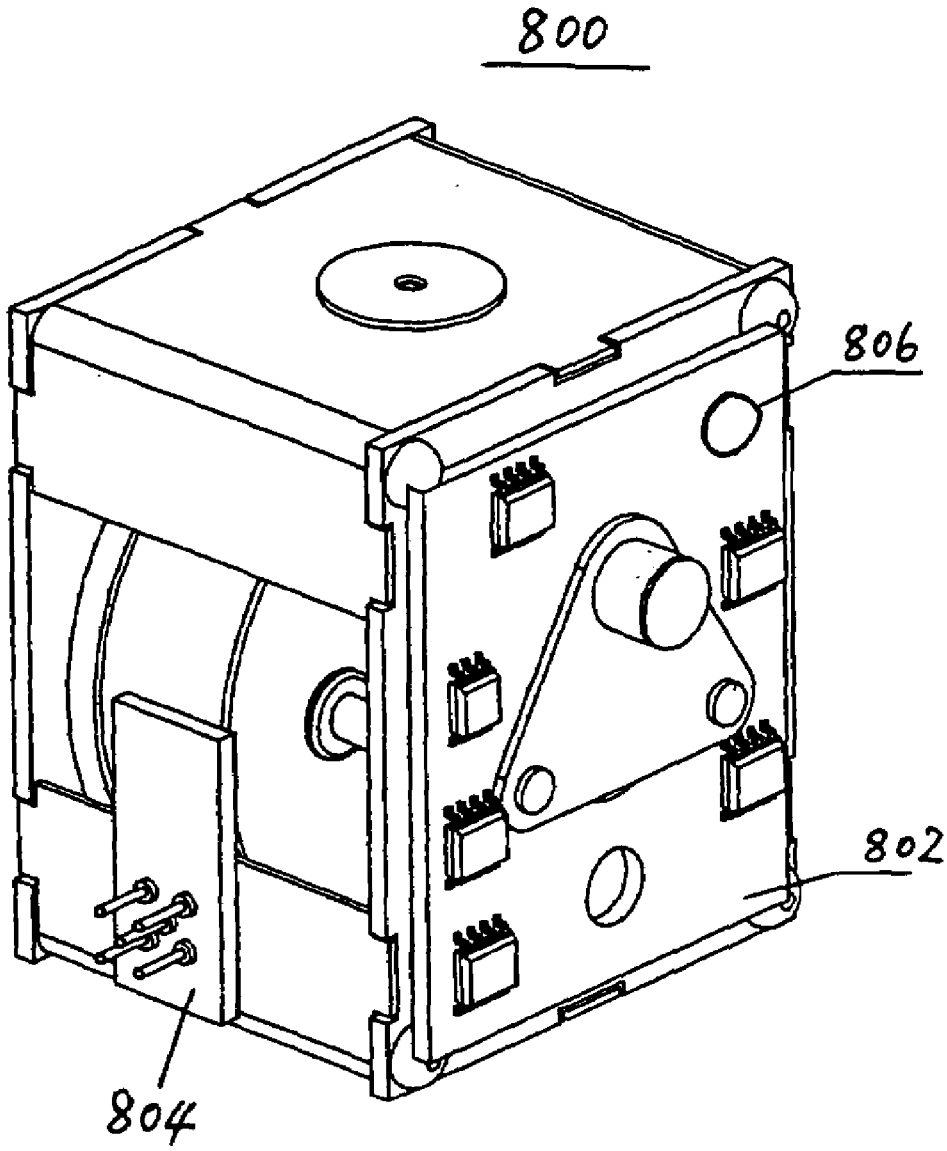
FIG. 8 shows another sensor according to the principles of the invention.

Exemplary signal conditioning board layout 802 and connector 804 particulars are shown in another embodiment 800 depicted in FIG. 8. Operation of the sensor is as previously described. In addition to IC layout, location of a reference Hall effect sensor 806 is also shown.

Other, contacting sensing elements can also be used in the present invention to sense the position of the threaded extension and including, but not limited to, potentiometers. Where describing a sensing element and a target magnet, the two components can be reversed, that is, in the foregoing description of sensing the position of the threaded extension, the target magnet may be fixed to the stationary frame or the threaded extension and the sensing element fixed to the stationary frame or the threaded extension, respectively.

It is to be understood that the invention is not limited to the illustrated and described embodiments contained herein. Other types of transducers can be implemented without departing from the principles of the invention, including differential variable reluctance transducers (DVRTs®), wire wound potentiometers, conductive plastic potentiometers, inductive or capacitive sensors, Hall-effect transducers, or sensors based upon light emitting diodes, or laser light. It will be apparent to those skilled in the art that various changes may be made without departing from the scope of the invention and the invention is not considered limited to what is shown in the drawings and described in the specification. In particular, various features of the described embodiments can be added or substituted for features in other of the embodiments, depending upon particular requirements. All such combinations are considered to be described herein.

What is claimed is:

1. A position sensor for sensing the position of a piston movable within a cylinder comprising:

a frame;

a spool rotatably mounted to the frame;

a cable windable about the spool and having a distal end adapted to be affixed to the piston, wherein the spool rotates as the cable winds and unwinds in relation to the movement of the piston, said spool operable to travel along a substantially linear path in response to the rotational movement of the spool;

and a sensing means adapted to sense the position of the spool along its substantially linear path, wherein the sensing means includes a transducer mounted to the exterior of the frame and operably disposed to a target magnet movable in cooperation with the movement of the spool.

2. The position sensor of claim 1 wherein said transducer is a Hall-effect transducer.

3. The position sensor of claim 1 wherein the spool travels along a linear path that is parallel to the rotational axis of the spool.

4. The position sensor of claim 1 wherein the spool has a threaded engagement with the frame to cause the linear travel of the spool as the spool rotates.

5. The position sensor of claim 1 wherein the spool has a threaded extension that is threadedly engaged with a threaded opening in the frame.

6. The position sensor of claim 5 wherein the frame has a bushing having threads formed therein and the threaded extension has mating threads.

7. The position sensor of claim 5 wherein said sensor includes a backlash mechanism to prevent backlash within the threaded engagement between the threaded extension and the frame.

8. The position sensor of claim 7 wherein the backlash mechanism comprises a spring adapted to create a constant bias on the threaded extension to force the threaded extension against the threaded opening in the frame to prevent backlash therebetween.

9. The position sensor of claim 8 wherein the backlash mechanism comprises an arm pivotally affixed to the frame, the arm adapted to engage the threaded extension to create a constant bias on the threaded extension to force the threaded extension against the threaded opening in the frame to prevent backlash therebetween and wherein the sensing means comprises a sensor affixed to the arm to sense the position of the spool.

10. The position sensor of claim 9 wherein there is a magnet affixed to the frame and the sensor comprises a Hall effect sensor that cooperates with the magnet to sense the position of the arm.

11. The position sensor of claim 1 wherein the pitch of the threaded engagement causes the spool to travel a distance along its linear path about the width of the cable for each 360 degrees of rotation of the spool.

12. The position sensor of claim 1 wherein a recoil spring biases the rotational movement of the spool to cause the cable to wind up or the spool.

13. The position sensor of claim 12 wherein the recoil spring has one end affixed to the rotatable spool and another end is fixed with respect to the frame.

14. The position sensor of claim 13 wherein the recoil spring is a spiral spring having an outer end and an inner end and wherein the outer end is affixed to the rotatable spool and the inner end is fixed with respect to the frame.

15. The position sensor of claim 14 wherein the inner end of the spiral spring is affixed to a hub that is rotatably fixed with respect to the frame but is movable linearly along with the linear travel of the spool.

16. The position sensor of claim 15 wherein the spool has a hollowed out area and the spiral spring is located within the hollowed out area within the spool.

17. The position sensor of claim 16 wherein a cover plate covers the hollowed out area enclosing the spiral spring within the spool.

18. The sensor of claim 1 wherein the sensing means further includes a magnet in moveable cooperation with the rotating spool and adapted to translate linearly proximate the Hall effect sensor such that the Hall effect sensor provides a position related signal relative to a position of the magnet.

19. The sensor of claim 18 further comprising an adjustment mechanism to adjust an offset between the Hall effect sensor and the magnet.

20. The sensor of claim 18 further comprising a reference Hall-effect chip mounted in fixed relation to the magnet and a circuit operable to compensate for a difference in outputs for the Hall-effect sensor and the reference Hall-effect chip.

21. The sensor of claim 1 wherein the sensing means includes temperature sensitive elements, the sensor further comprising a temperature compensation element.

22. The sensor of claim 21 wherein the temperature compensation element includes an electronic compensation circuit.

23. The sensor of claim 21 wherein the compensation element comprises a temperature sensitive metal.

24. The position sensor of claim 1 wherein the sensing means includes an inductive transducer.

25. A position sensor comprising:

a frame;

a spool rotatably mounted to the frame;

a cable windable about the spool and having a distal end adapted to be affixed to the object to be sensed, wherein the spool rotates as the cable winds and unwinds in relation to the movement of the object, said spool operable to travel along a substantially linear path in response to the rotational movement of the spool;

and a sensing means adapted to sense the position of the spool along its substantially linear path, wherein the sensing means includes a Hall-effect transducer mounted to the exterior of the frame and operably disposed to a target magnet movable in cooperation with the movement of the spool.

26. A position sensor comprising:

a frame having a bushing having threads formed therein:

a spool rotatably mounted to the frame, the spool having a threaded extension having mating threads with the bushing and is threadedly engaged with the threaded bushing;

a cable windable about the spool and having a distal end adapted to be affixed to the object to be sensed, wherein time spool rotates as the cable winds and unwinds in relation to the movement of the object, said spool operable to travel along a substantially linear path in response to the rotational movement of the spool;

and a sensing means adapted to sense the position of the spool along its substantially linear path.

27. The position sensor of claim 26 wherein the sensing means includes an inductive transducer.

28. A position sensor comprising:

a frame;

a spool rotatably mounted to the frame, the spool having a threaded extension having mating threads with the bushing and is threadedly engaged with the threaded bushing;

a cable windable about the spool and having a distal end adapted to be affixed to the object to be sensed, wherein the spool rotates as the cable winds and unwinds in relation to the movement, of the object, said spool operable to travel along a substantially linear path in response to the rotational movement of the spool;

and a sensing means adapted to sense the position of the spool along its substantially linear path;

the sensor further including a backlash mechanism to prevent backlash within the threaded engagement between the threaded extension and the frame, the backlash mechanism comprises an arm pivotally affixed to the frame, the arm adapted to engage the threaded extension to create a constant bias on the threaded extension to force the threaded extension against the threaded opening in the frame to prevent backlash therebetween, and wherein the sensing means is affixed to the arm to sense the position of the spool.

29. The position sensor of claim 28 wherein there is a magnet, affixed to the frame and the sensor comprises a Hall effect sensor that cooperates with the magnet to sense the position of the arm.

30. The position sensor of claim 28 wherein the sensing means includes an inductive transducer.

31. A position sensor comprising:

a frame;

a spool rotatably mounted to the frame;

a cable windable about the spool and having a distal end adapted to be affixed to the object to be sensed, wherein the spool rotates as the cable winds and unwinds in relation to the movement of the object, said spool operable to travel along a substantially linear path in response to the rotational movement of the spool;

a recoil spring that biases the rotational movement of the spool to cause the cable to wind up on the spool, the recoil spring having one end affixed to the rotatable spool and the other end fixed with respect to the frame;

and a sensing means adapted to sense the position of the spool along its substantially linear path.

32. The position sensor of claim 31 wherein the recoil spring is a spiral spring having an outer end and an inner end and wherein the outer end is affixed to the rotatable spool and the inner end is fixed with respect to the frame.

33. The position sensor of claim 32 wherein the inner end of the spiral spring is affixed to a hub that is rotatably fixed with respect to the frame but is movable linearly along with the linear travel of the spool.

34. The position sensor of claim 33 wherein the spool has a hollowed out area and the spiral spring is located within the hollowed out area within the spool.

35. The position sensor of claim 34 wherein a cover plate covers the hollowed out area enclosing the spiral spring within the spool.

36. The position sensor of claim 31 wherein the sensing means includes an inductive transducer.

37. A position sensor comprising:

a frame;

a spool rotatably mounted to the frame;

a cable windable about the spool and having a distal end adapted to be affixed to the object to be sensed, wherein the spool rotates as the cable winds and unwinds in relation to the movement of the object, said spool operable to travel along a substantially linear path in response to the rotational movement of the spool;

a recoil spring that biases the rotational movement of the spool to cause the cable to wind up on the spool, the recoil spring having an outer end affixed to the rotatable spool and an inner end affixed to a hub that is linearly movable but is prevented from rotational movement with respect to the frame, the hub being affixed to the frame by means of at least one pin that extends between the hub and the frame and the at least one pin slidingly interfits in the hub to allow the hub to move linearly with respect to the frame;

and a sensing means adapted to sense the position of the spool along its substantially linear path.

38. The position sensor of claim 37 wherein the sensing means includes an inductive transducer.

39. A position sensor comprising:

a frame;

a spool rotatably mounted to the frame;

a cable windable about the spool and having a distal end adapted to be affixed to the object to be sensed, wherein the spool rotates as the cable winds and unwinds in relation to the movement of the object, said spool operable to travel along a substantially linear path in response to the rotational movement of the spool;

a sensing means adapted to sense the position of the spool along its substantially linear path, the sensing means including a magnet in moveable cooperation with the rotating spool and adapted to translate linearly proximate the Hall effect sensor such that the Hall effect sensor provides a position related signal relative to a position of the magnet;

the sensor further comprising a reference Hall effect chip mounted in fixed relation to the magnet and a circuit operable to compensate for a difference in outputs for the Hall effect sensor and the reference Hall effect chip.

40. A position sensor for sensing the position of a piston movable within a cylinder comprising:

a frame, the frame having a threaded opening in the form of a bushing having threads formed therein;

a spool rotatably mounted to the frame the spool having a threaded extension having mating threads with the bushing and threadedly engaged with the bushing;

a cable windable about the spool and having a distal end adapted to be affixed to the piston, wherein the spool rotates as the cable winds and unwinds in relation to the movement of the piston, said spool operable to travel along a substantially linear path in response to the rotational movement of the spool;

and a sensing means adapted to sense the position of the spool along its substantially linear path.

41. A position sensor for sensing the position of a piston movable within a cylinder comprising:

a frame having a threaded opening;

a spool rotatably mounted to the frame, said spool having a threaded extension that is threadedly engaged with the threaded opening in said frame;

a cable windable about the spool and having a distal end adapted to be affixed to the piston, wherein the spool rotates as the cable winds and unwinds in relation to the movement of the piston, said spool operable to travel along a substantially linear path in response to the rotational movement of the spool;

and a sensing means adapted to sense the position of the spool along its substantially linear path, wherein said sensing means includes a backlash mechanism to prevent backlash within the threaded engagement between the threaded extension and the frame, wherein said backlash mechanism comprises a spring adapted to create a constant bias on the threaded extension to force the threaded extension against the threaded opening in the frame to prevent backlash therebetween and wherein the backlash mechanism further comprises an arm pivotally affixed to the frame, the arm adapted to engage the threaded extension to create a constant bias on the threaded extension to force the threaded extension against the threaded opening in the frame to prevent backlash therebetween and wherein the sensing means comprises a sensor affixed to the arm to sense the position of the spool.

42. The position sensor of claim 41 wherein there is a magnet affixed to the frame and the sensor comprises a Hall effect sensor that cooperates with the magnet to sense the position of the arm.

43. A position sensor for sensing the position of a piston movable within a cylinder comprising:

a frame;

a spool rotatably mounted to the frame;

a cable windable about the spool and having a distal end adapted to be affixed to the piston, wherein the spool rotates as the cable winds and unwinds in relation to the movement of the piston, said spool operable to travel along a substantially linear path in response to the rotational movement of the spool;

and a sensing means adapted to sense the position of the spool along its substantially linear path, wherein a recoil spring biases the rotational movement of the spool to cause the cable to wind up on the spool and wherein the recoil spring has one end affixed to the rotatable spool and another end is fixed with respect to the frame.

44. The position sensor of claim 43 wherein the recoil spring is a spiral spring having an outer end and an inner end and wherein the outer end is affixed to the rotatable spool and the inner end is fixed with respect to the frame.

45. The position sensor of claim 44 wherein the inner end of the spiral spring is affixed to a hub that is rotatably fixed with respect to the frame but is movable linearly along with the linear travel of the spool.

46. The position sensor of claim 45 wherein the spool has a hollowed out area and the spiral spring is located within the hollowed out area within the spool.

47. The position sensor of claim 46 wherein a cover plate covers the hollowed out area enclosing the spiral spring within the spool.

48. A position sensor for sensing the position of a piston movable within a cylinder, the sensor comprising a frame, a spool rotatably affixed within the frame about a central axis of rotation, the spool having a threaded extension extending therefrom and which is threadedly engaged through an opening in the frame, a feed point opening in said frame located in close proximity to the spool, and a cable passing through the feed point opening having an end adapted to be affixed to the piston and adapted to be wound around the spool to form a plurality of individual windings adjacent to but not overlapping each other, said spool adapted to move linearly along its axis of rotation as the cable is wound or unwound about the spool, wherein the linear movement of the spool through one full rotation is about one cable width, wherein the position sensor further includes a recoil spring having an outer end affixed to the spool and an inner end that is affixed to a hub that is linearly movable with respect to the frame but is prevented from rotational movement with respect to the frame and wherein the hub is affixed to the frame by means of at least one pin that extends between the hub and the frame and the at least one pin slidingly interfits in the hub to allow the hub to move linearly with respect to the frame.

49. A position sensor for sensing the position of a piston movable within a cylinder comprising:

a frame;

a spool rotatably mounted to the frame;

a cable windable about the spool and having a distal end adapted to be affixed to the piston, wherein the spool rotates as the cable winds and unwinds in relation to the movement of the piston, said spool operable to travel along a substantially linear path in response to the rotational movement of the spool;

and a sensing means adapted to sense the position of the spool along its substantially linear path, wherein the sensing means includes a magnet in movable cooperation with the rotating spool and adapted to translate linearly proximate a Hall effect sensor such that the Hall effect sensor provides a position related signal relative to a position of the magnet, the sensing means further including a reference Hall-effect chip mounted in fixed relation to the magnet and a circuit operable to compensate for a difference in outputs for the Hall-effect sensor and the reference Hall-effect chip.

* * * * *